US007212763B2

(12) United States Patent
Sakoh et al.

(10) Patent No.: US 7,212,763 B2
(45) Date of Patent: May 1, 2007

(54) IMAGE FORMING APPARATUS AND SEAL PORTION FOR USE IN THE SAME

(75) Inventors: Kiyoshi Sakoh, Saitama (JP); Masaru Sakuma, Saitama (JP); Toru Isosu, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/179,583

(22) Filed: Jul. 13, 2005

(65) Prior Publication Data

US 2006/0210301 A1 Sep. 21, 2006

(30) Foreign Application Priority Data

Mar. 17, 2005 (JP) ..... P.2005-077184

(51) Int. Cl.
*G03G 15/08* (2006.01)

(52) U.S. Cl. ..... 399/105; 399/102; 399/103; 399/106

(58) Field of Classification Search ..... 399/106, 399/105, 102, 103
See application file for complete search history.

(56) References Cited

U.S. PATENT DOCUMENTS 5,080,745 A * 1/1992 Paull ..... 399/102
5,937,237 A * 8/1999 Nonaka et al. ..... 399/106
2005/0158071 A1* 7/2005 Hosokawa et al. ..... 399/103

FOREIGN PATENT DOCUMENTS

JP 3054323 B2 4/2000
JP 2002-341650 A 11/2002

* cited by examiner

*Primary Examiner*—David M. Gray
*Assistant Examiner*—Ruth N. LaBombard
(74) *Attorney, Agent, or Firm*—Sughrue Mion, PLLC

(57) ABSTRACT

An image forming apparatus including: an image forming apparatus main unit; an image carrier provided in the image forming apparatus main unit; at least one developing device supported retractable from the image carrier; and a developer supply portion adapted to supply developer to the developing device, wherein: a developer inlet port provided in the developing device is slidably joined with a developer supply port provided in the developer supply portion; a seal portion is provided between the developer inlet port and the developer supply port; the seal portion includes a seal portion body made of an elastic material, a sliding portion provided on at least one of surfaces of the seal portion body, and a drawing-out portion connected to the seal portion body and to the sliding portion; and the seal portion is enabled to be drawn out by using the drawing-out portion.

16 Claims, 9 Drawing Sheets

IMAGE FORMING APPARATUS AND SEAL PORTION FOR USE IN THE SAME

BACKGROUND OF THE INVENTION

1. Field of the Invention

The present invention relates to an image forming apparatus, such as a printer, a facsimile, and a copying machine, and to a seal portion for use in the image forming apparatus.

2. Background Art

An image forming apparatus has, within an image forming apparatus main unit thereof, an image carrier constituted by, for example, a photoreceptor, an optical writing device adapted to form a latent image on this image carrier, and a developing device adapted to visualize the latent image formed on the image carrier by this optical writing device. A developer supply portion supplies developer to the developing device. There has been known one such a developing device which is disposed retractable from the image carrier and which is adapted to be retracted, for instance, in a case where the image carrier is exchanged, thereby to prevent the image carrier from being damaged, for example, being scratched. In the case where the developing device is retracted, a developer inlet port provided in the developing device is slidably joined with a developer supply port provided in the developer supply portion.

Incidentally, JP-A-2002-341650 discloses technology of applying a film member to an elastic member fixed to the periphery of at least one of openings, which are respectively provided in two casings so that developer is transferred therebetween, thereby to enhance slidability at opening/closing of the opening portions of the two casings and also enhance ability to seal the leakage of toner. Also, Japanese Patent No. 3054323 discloses technology of pasting an elastic member onto a sliding portion, which slides through a guide portion of an openable and closable shutter of a refill toner container, and also coating a film member, which is applied to a sliding surface of the sliding portion, with a coating layer made of a silicon based material so that the container has good slidability at opening/closing of the shutter and excels in ability to seal the leakage of toner.

At shipping inspection of an image forming apparatus, developer is supplied into a developing device. Then, an image is printed on test paper by using the developer stored in the developing device. However, there has been caused a problem that the developer stored in the developing device leaks from the developer inlet port, the developer supply port, and the sliding portion during the image forming apparatus is transported after the shipping inspection. Neither JP-A-02-341650 nor Japanese Patent No. 3054323 discloses how to assure sealability against the leakage of developer from the developer inlet port, the developer supply port, and the sliding portion.

SUMMARY OF THE INVENTION

An object of the invention is to provide an image forming apparatus, which is enabled to assure sealability against the leakage of developer from the developer inlet port, the developer supply port, and the sliding portion and also enabled to facilitate the shipping inspection thereof, and is to provide a seal portion for use in the image forming apparatus.

According to a first aspect of the invention, there is provided an image forming apparatus, which includes an image forming apparatus main unit, an image carrier provided in the image forming apparatus main unit, at least one developing device supported retractable from the image carrier, and a developer supply portion adapted to supply developer to the developing device. This image forming apparatus features that a developer inlet port provided in the developing device is slidably joined with a developer supply port provided in the developer supply portion, that a seal portion is provided between the developer inlet port and the developer supply port, that the seal portion includes a seal portion body made of an elastic material, a sliding portion provided on at least one of surfaces of the seal portion body, and a drawing-out portion connected to the seal portion body and to the sliding portion, and that the seal portion is enabled to be drawn out by using the drawing-out portion. Thus, the sealability can be assured by providing the seal portion between the developer inlet port and the developer supply port, which slide with respect to each other. Additionally, this seal portion has the sliding portion and the drawing-out portion. Thus, the shipping inspection of the image forming apparatus can be performed by leaving the seal portion untouched. Also, the seal portion can easily be drawn out by holding the drawing-out portion and using the sliding portion. Consequently, the shipping inspection can easily be completed.

Preferably, the sliding portion of the seal portion is disposed to face a sliding part of each of the developer inlet port and the developer supply port. Consequently, the slidability between the developer inlet port and the developer supply port can be enhanced.

Preferably, the developing device has an auger adapted to convey developer inputted from the developer inlet port. Also, the sliding portion of the seal portion is disposed to face the auger. Consequently, the slidability between the sliding portion of the seal portion and the auger can be enhanced.

Preferably, the image forming apparatus has a plurality of the developing devices. Also, the seal portions are disposed in the plurality of the developing devices, respectively, and are collectively drawn out therefrom by using one jig. Thus, the plural seal portions can be drawn out by using one jig. Consequently, workability can be improved.

Preferably, the sliding portion and the drawing-out portion are formed of flexible film integrally with each other. Thus, the sliding portion and the drawing-out portion are formed integrally with each other. Consequently, as compared with a case that the sliding portion and the drawing-out portion are formed separately from each other, the number of components can be reduced.

According to a second aspect of the invention, there is provided a seal portion for use in an image forming apparatus, which is adapted to seal a developer inlet port, which is provided in a developing device, and a developer supply port provided in a developer supply portion. The seal portion includes a seal portion body made of an elastic material, and also includes a sliding portion, which is provided on at least one of side surfaces of the seal portion body, and a drawing-out portion connected to the seal portion body and to the sliding portion. The seal portion can be drawn out therefrom by using this drawing-out portion.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

An embodiment of the invention is described hereinbelow with reference to the accompanying drawings.

Figure 1:
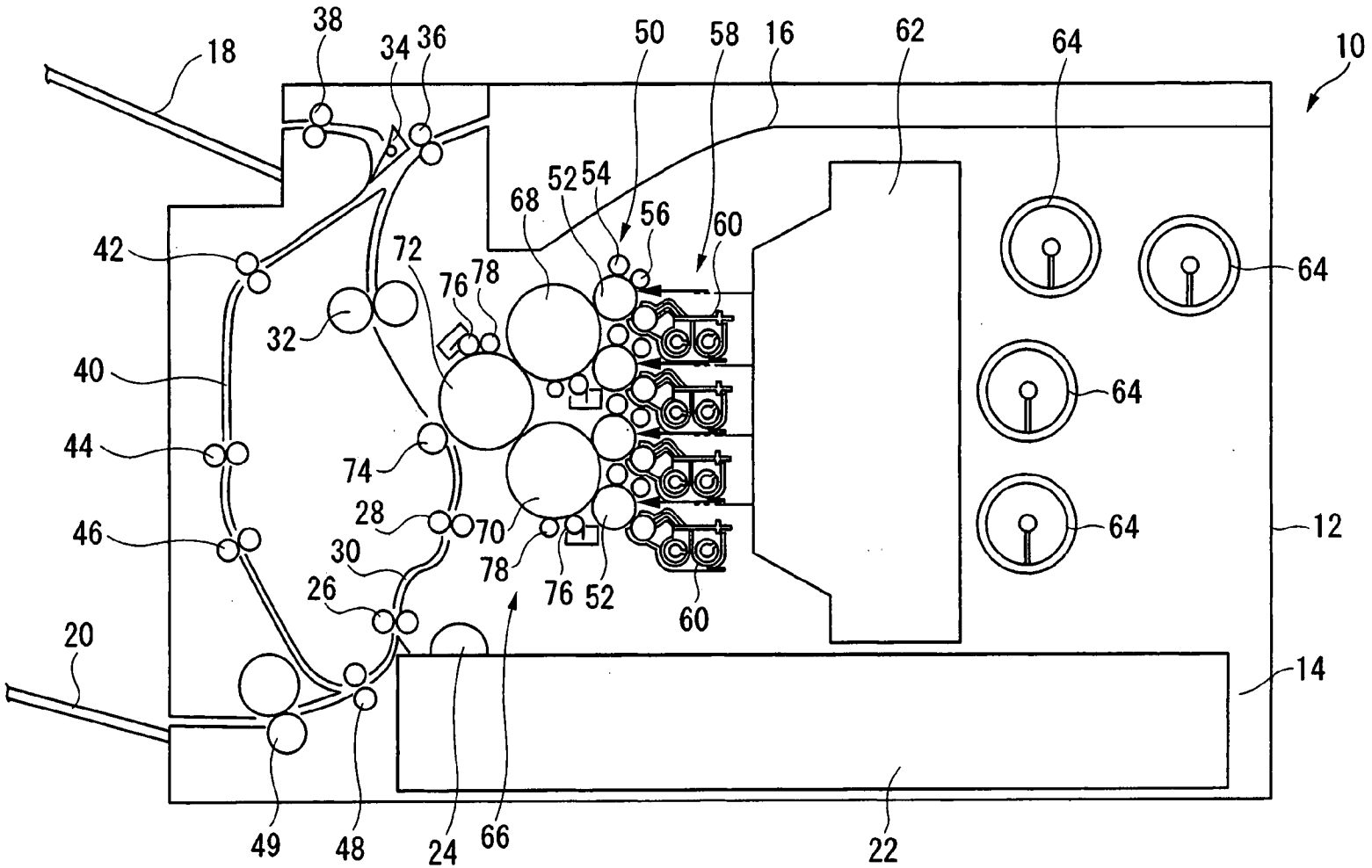
FIG. 1 is a side view illustrating an image forming apparatus according to an embodiment of the invention.

FIG. 1 shows an outline of an image forming apparatus 10 according to an embodiment of the invention. The image forming apparatus 10 has an image forming apparatus main unit 12. A paper supply unit 14 is provided in a lower portion of this image forming apparatus main unit 12. Also, a first ejection tray 16 is provided on the top surface of the image forming apparatus main unit 12. A second ejection tray 18 is provided on the left side surface of the image forming apparatus main unit 12 and faces this first ejection tray 16. Also, a manual feed tray 20 is provided on the left-side lower portion of the image forming apparatus main unit 12.

The paper supply unit 14 has a paper tray 22, on which sheets of paper are stacked, and a paper supply roll 24 adapted to feed out sheets of paper from this paper tray 22. The sheet of paper fed out of this paper supply roll 24 is transported on a paper supply path 30 through conveying rolls 26 and 28 to a transfer roll 74 (to be described later). A toner image is transferred by this transfer roll 74. The toner image is fixed by a fixing roll 32. The first ejection tray 16 or the second ejection tray 18 is selected according to the position of a switch claw 34. The sheet of paper is ejected by an ejection roller 36 or 38. The sheet of paper is ejected to the first tray 16 with the sheet's side on which the toner image is fixed as the back face thereof. The sheet of paper is ejected to the second tray 18 with the sheet's side, on which the toner image is fixed, as the front face thereof.

Incidentally, in the case of double-sided printing, when the sheet of paper is about to be ejected to the first ejection tray 16, the ejection roll 36 is reversely rotated to thereby supply the sheet of paper to a reverse path 40. Thereafter, the sheet of paper is returned to the paper supply path 30 by using conveying rolls 42, 44, 46, and 48. Then, the back face of the sheet of paper is printed. The sheets of paper stacked on the manual feed tray 20 are supplied by a manual feed roll 49 and are transported to the paper supply path 30 through the conveying roll 48.

A photoreceptor unit 50 has four photoreceptors 52 that are used corresponding to, for example, yellow, magenta, black, and cyan light, respectively, and that are longitudinally arranged from the top, as viewed in this figure. This photoreceptor unit 50 is provided with sets of a refresh roll 54 and a charging roll 56, which rotate in contact with a corresponding one of the photoreceptors 52.

A developing device unit 58 is disposed at the right side of the photoreceptor unit 50, as viewed in this figure. The developing devices 60 of the developing device unit 58 are longitudinally arranged corresponding to the photoreceptors 52, respectively. The developing device 60 employs what is called a trickle developing system, so that excessive developer is collected into a collection container. An exposure unit 62 is disposed at the right side of this developing device unit 58. Four laser light beams according to an image signal are emitted from this exposure unit 62, so that a latent image is formed on the photoreceptors 52. Four developer cartridges 64 are disposed at the right side of this exposure unit 62, as viewed in this figure. The developer cartridges 64 and the developing devices 60 are connected through developer supply portions (to be described later) so that developer is supplied from the developer cartridges 64 to the developing devices 60.

An intermediate transfer unit 66 is disposed at the left side of the photoreceptor unit 50, and has three drum-like intermediate transfer bodies 68, 70, and 72. The two first transfer bodies 68 and 70 are longitudinally arranged. An upper one of the first intermediate transfer bodies 68 rotates in contact with the two upper photoreceptors 52 and 52. A lower one of the first intermediate transfer bodies 70 rotates in contact with the two lower photoreceptors 52 and 52. The second intermediate transfer body 72 rotates in contact with both the first intermediate transfer bodies 68 and 70. The transfer roll 74 rotates in contact with this second intermediate transfer body 72. Thus, toner images respectively having two colors are transferred from the two sets of the two photoreceptors 52 and 52 to the first intermediate transfer bodies 68 and 70, respectively. The toner images of two colors transferred to each of the first intermediate transfer bodies 68 and 70 are then transferred to the second intermediate transfer body 72, so that a toner image of four colors is obtained. This toner image of four colors is transferred by this transfer roll 74 onto a sheet of paper. A cleaning roll 76 and a cleaning brush 78 are disposed at each of the intermediate transfer bodies 68, 70, and 72. Toner caught by the cleaning roll 76 is scraped off by, for instance, a blade. The scraped-off toner is collected into a collection container (not shown).

Figure 2:
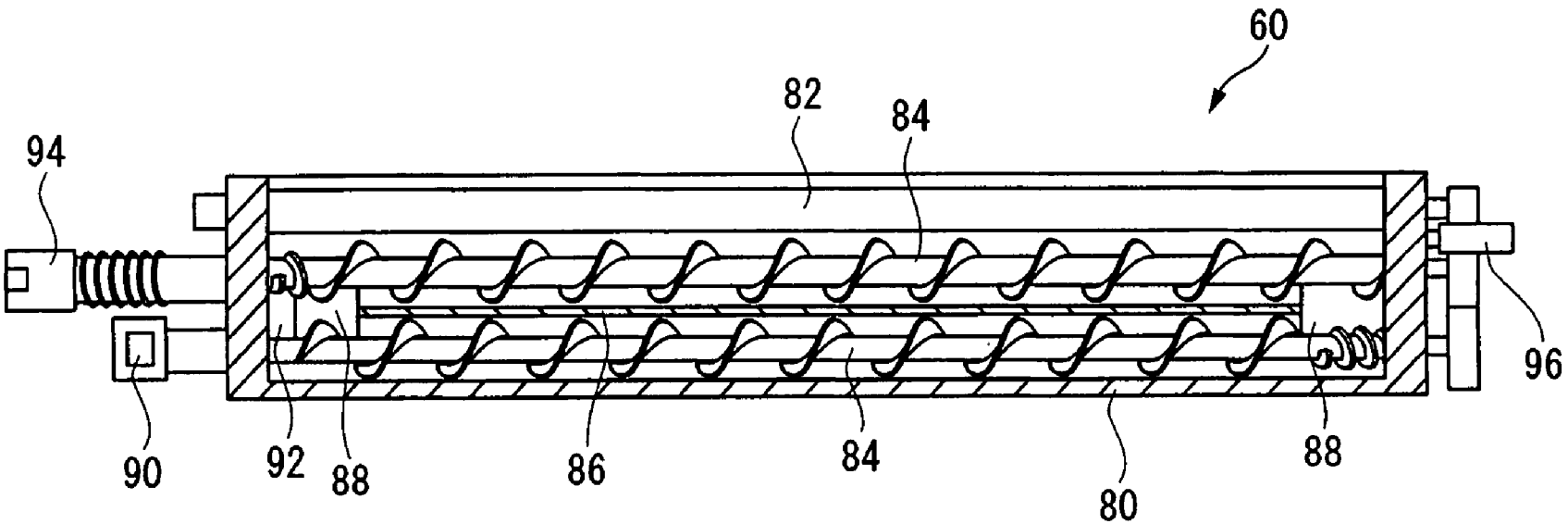
FIG. 2 is a cross-sectional view illustrating a developing device used in the image forming apparatus according to the embodiment of the invention.
Figure 3:
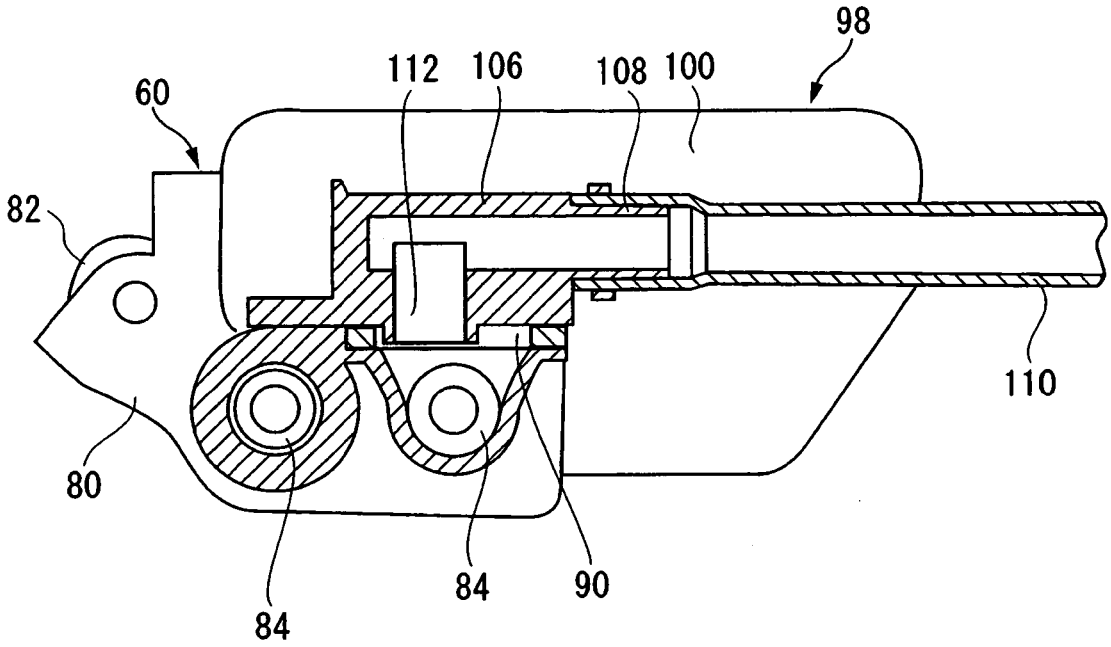
FIG. 3 is a cross-sectional view illustrating the developing device and a developer supply portion, which are used in the image forming apparatus according to the embodiment of the invention.
Figure 4:
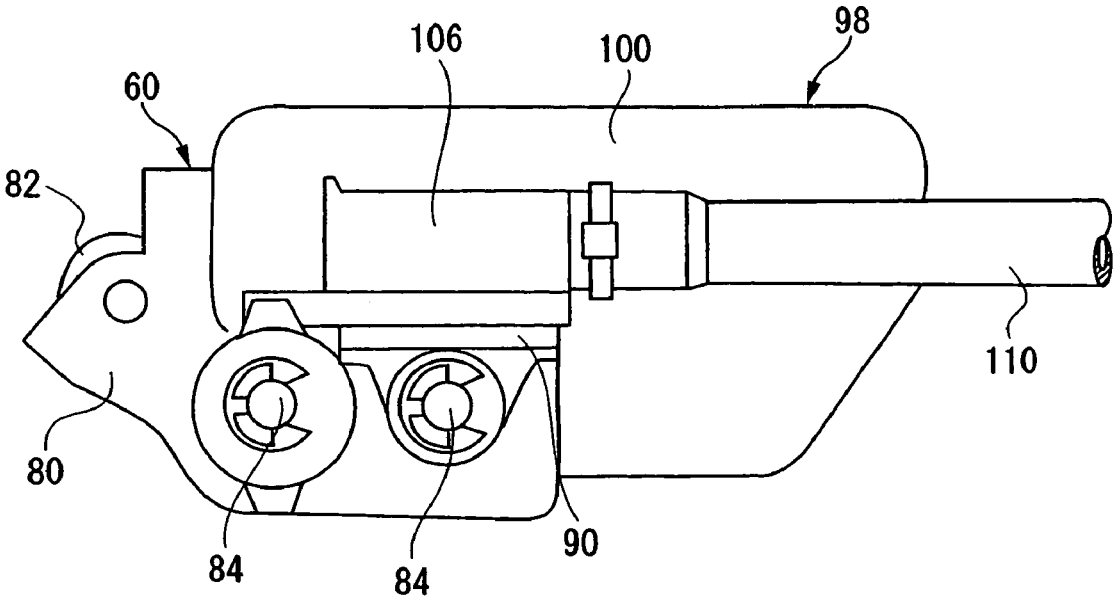
FIG. 4 is a side view illustrating the developing device and the developer supply portion, which are used in the image forming apparatus according to the embodiment of the invention.

FIG. 2 shows a practical example of the aforementioned developing device 60. As described above, the developing device 60 employs what is called the trickle developing system. A magnet roll 82 and two spiral augers 84 are rotatably supported in a developing device main unit 80. The two augers 84 rotate in opposite directions, respectively, and are partitioned by a wall 86 formed n the developing device main unit 80. The augers 84 are connected to each other through circulating ports 88 and 88 respectively formed in the vicinities of both end portions thereof. Developer put into the developing device main unit 80 from a developer inlet port 90 is circulated in the developing device main unit 80 and is supplied to the magnet roll 82. A step-like portion 92 constituting a collection developer generating portion is formed at one end portion of the developing device main unit 80. A part of the circulated developer is taken into this step-like portion 92. Then, the taken-in developer is sent to a discharge portion 94 that is connected to a collection port of a collection container (not shown). Also, an input gear 96 for driving the developing device 60 is provided at the other end portion of the developing device main unit 80. The magnet roll 80 and the augers 84 are rotated by being driven by the input gear 96.

FIGS. 3 to 7 show a connection portion between the developing device 60 and the developer supply portion 98 in detail.

Figure 5:
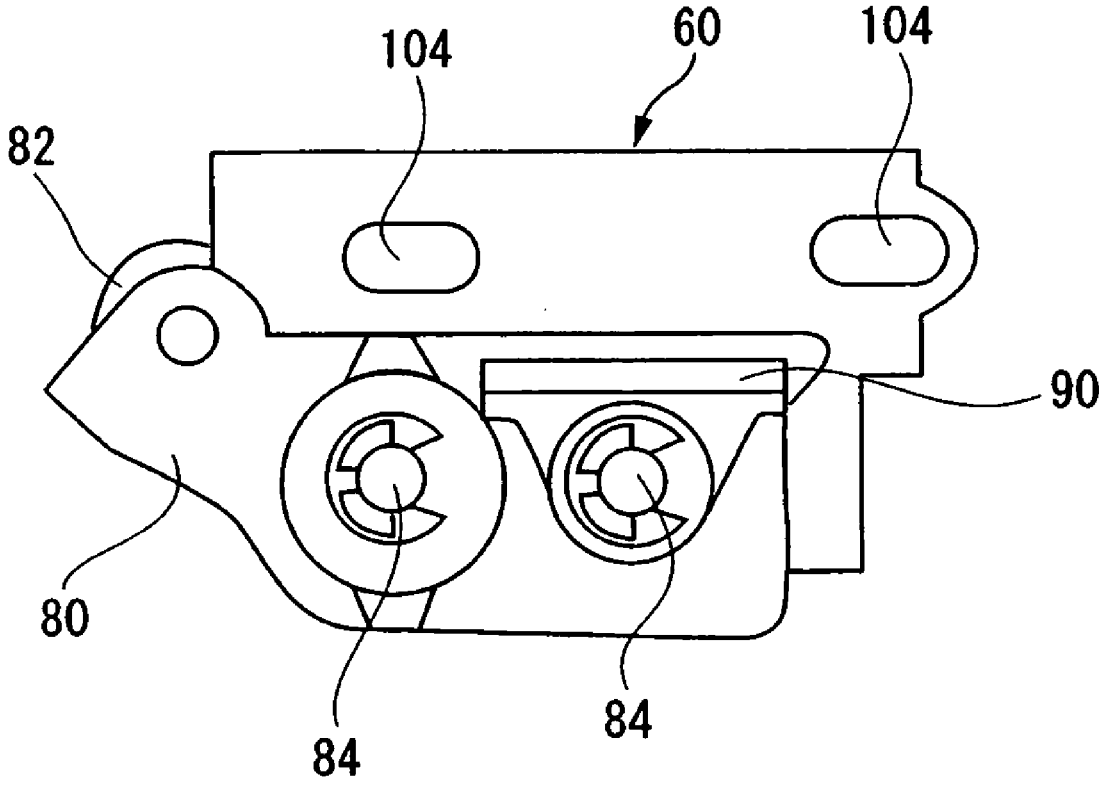
FIG. 5 is a side view illustrating the developing device used in the image forming apparatus according to the embodiment of the invention.
Figure 6:
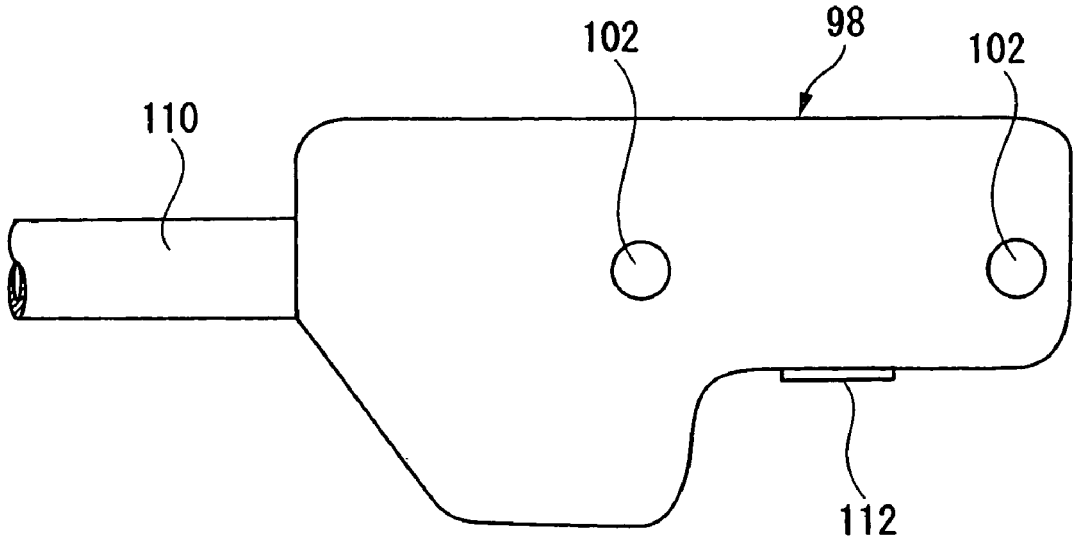
FIG. 6 is a side view illustrating the developer supply portion used in the image forming apparatus according to the embodiment of the invention.
Figure 7:
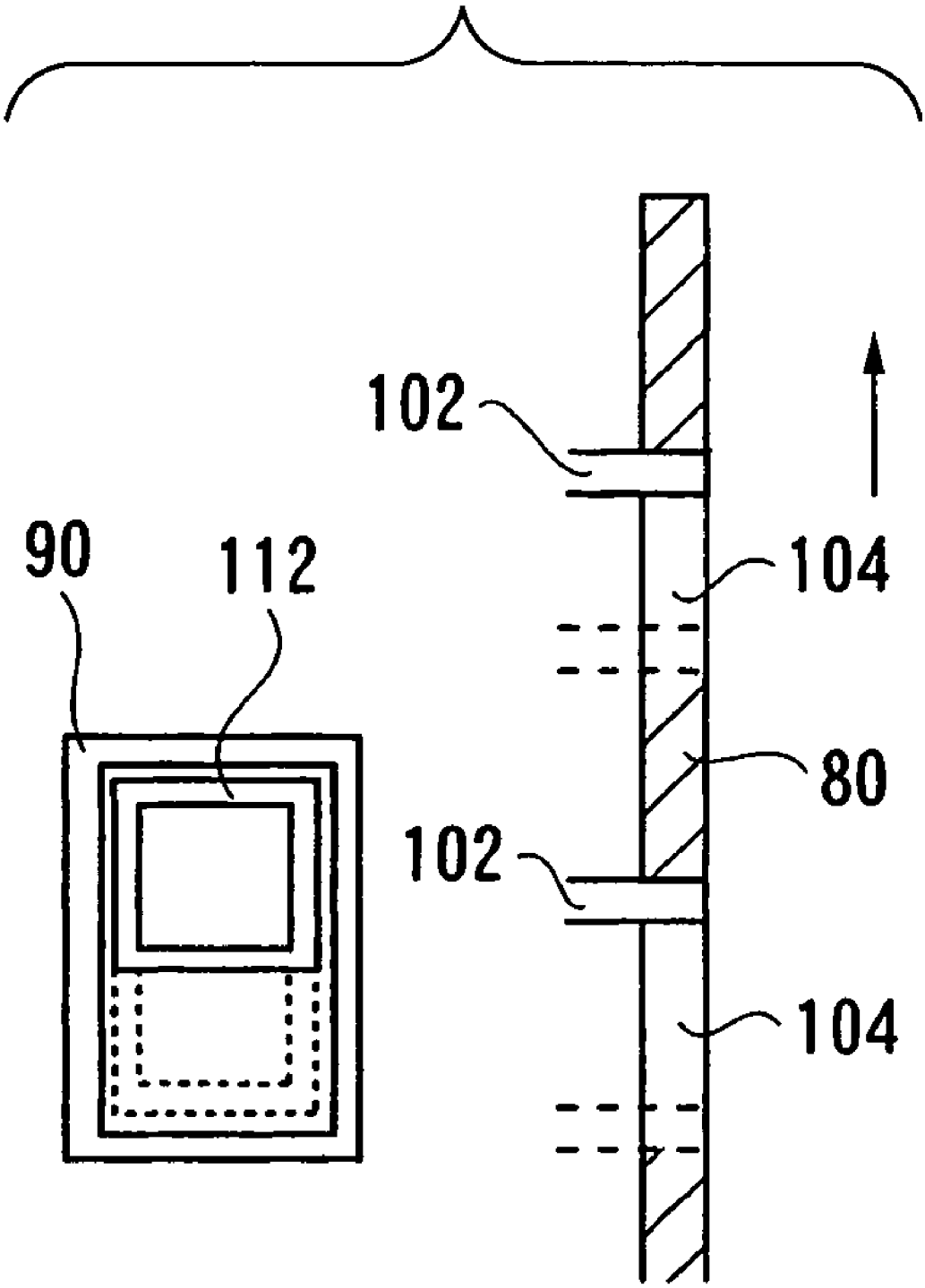
FIG. 7 is a cross-sectional view illustrating the developing device and a part of the developer supply portion, which are used in the image forming apparatus according to the embodiment of the invention.

The developer supply portion 98 has a developer supply portion main unit 100 made of, for instance, POM (polyacetal). This developer supply portion main unit 100 is fixed to the aforementioned image forming apparatus main unit 12. For example, two pins 102 and 102 are formed on the back surface of this developer supply portion main unit 100 in such a way as to protrude therefrom, as shown in FIG. 6. For instance, two elongated holes 104 and 104 are formed in an end surface of the developing device main unit 80, as shown in FIG. 5. The pins 102, 102 of the developer supply portion 98 are slidably engaged with the two elongated holes 104 and 104 of the developing device 60, respectively. The developing device 60 is slidably supported by the developer supply portion 98, as shown in FIG. 7.

The developer supply portion 98 is configured so that the connection portion 106 is formed integrally with the developer supply portion main unit 100. A connection port 108 is formed at an end of this connection portion 106. An end of a connection hose 110 is connected to this connection port 108. The other end of this connection hose 110 is connected to the aforementioned developer cartridge. Developer is supplied from the developer cartridge through this connection hose 110. Also, a developer supply port 112 opened downwardly is formed in the connection portion 106. This developer supply port 112 is joined with the developer inlet port 90 of the developing device 60 in such a manner as to be fitted to the port 90. As described above, the developing device 60 slides with respect to the developer supply portion 98. Thus, the developer inlet portion 90 is adapted to slide in a state in which the inlet portion 90 is fitted to the developer supply port 112. As indicated by an arrow shown in FIG. 7, the developing device 60 is moved from a position, which is indicated by solid lines, to another position indicated by dashed lines, so that the aforementioned magnet roll is put into contact with or is made to come closer to the photoreceptor.

An end of the aforementioned auger 84 faces the developer inlet port 90. Developer inputted from the developer inlet port 90 is conveyed into the developing device 60 by rotation of the auger 84.

Figure 8:
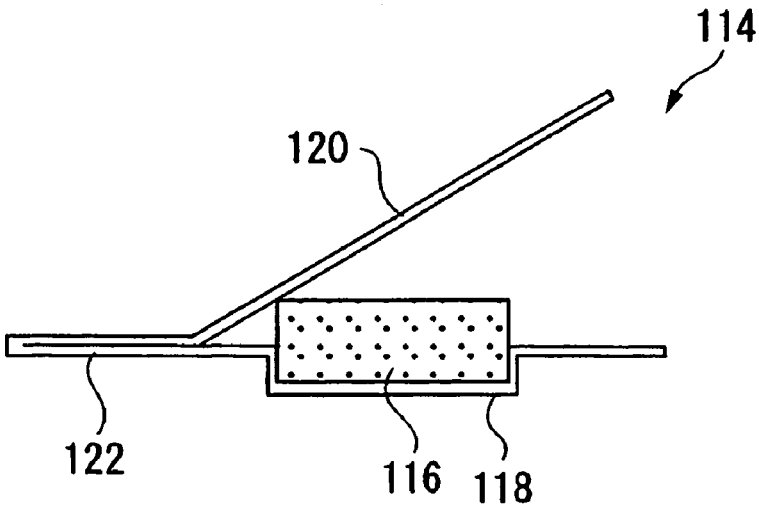
FIG. 8 is a side view illustrating a seal portion used in the image forming apparatus according to the invention.
Figure 9:
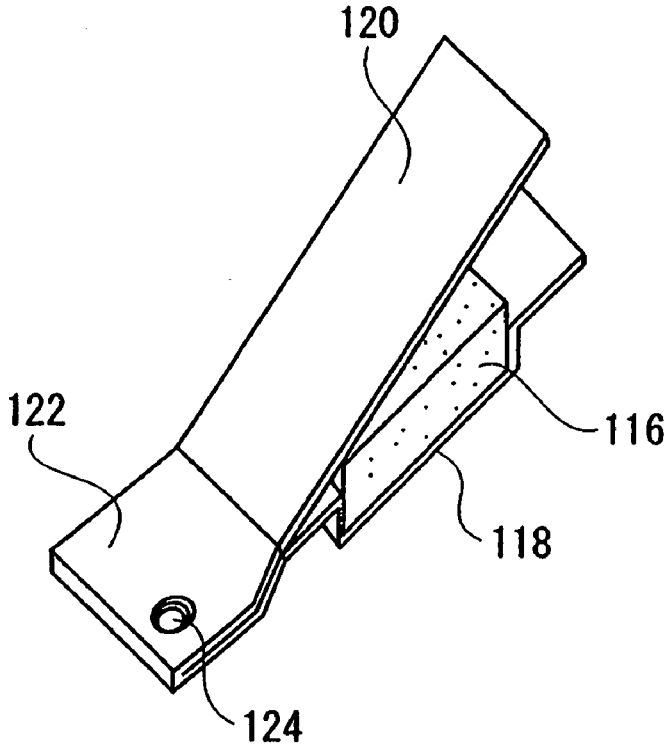
FIG. 9 is a perspective view illustrating the seal portion used in the image forming apparatus according to the invention.

In the developing device 60 and the developer supply portion 98, which are configured in this way, there is a fear that developer may leak from between the developer inlet port 90 and the developer supply port 112 during the image forming apparatus 10 is transported. Thus, in this embodiment, a seal portion 114 shown in FIGS. 8 and 9 is provided as a seal member used during the image forming apparatus 10 is transported.

The seal portion 114 has a seal portion body 116 and upper and lower sliding portions 118 and 120 provided in such a way as to cover this seal portion body 116. The seal portion body 116 is made of an elastic material, for example, urethane foam, and is formed like a rectangular parallelepiped. The outer shape of the seal portion body 116 is formed in such a way as to be slightly larger than the inner shape of the developer inlet port 90. The seal portion body 116 is fitted into the developer inlet port 90 by being compressed. The lower sliding portion 118 is made of a flexible material, for example, PET (Poly-Ethylene Terephthalate) film. This lower sliding portion 118 is substantially equal to the seal portion body 116 in width, and is bonded to the bottom surface of the seal portion body 116 by an adhesive. The lower sliding portion 118 extends upwardly from the bottom of the seal portion body 116 to a substantially central position of each of the front surface and the rear surface thereof, as viewed in the figures. Thus, the lower sliding portion 118 is bonded to the surface of the lower part of the seal portion body 116, which extends downwardly from the substantially central position of each of the front surface and the rear surface. An end part of the lower sliding portion 118 extends more frontwardly from the substantially center of the front surface of the seal portion body 116 and is connected to a drawing-out portion 122 (to be described later). The other end part of the lower sliding portion 118 extends rearwardly from the substantially center of the rear surface of the seal portion body 116 and behaves as a free end. On the other hand, the upper sliding portion 120 is made of a flexible material, for example, PET (Poly-Ethylene Terephthalate) film, similarly to the lower sliding portion 118. This upper sliding portion 120 is substantially equal to the seal portion body 116 in width, and has an end part connected to the drawing-out portion 122, similarly to the lower sliding portion 118. The other end part of the upper sliding portion 120 is placed above the seal portion body 116 and extends more rearwardly from the rear end of the seal portion body 116 and behaves as a free end.

Figure 10:
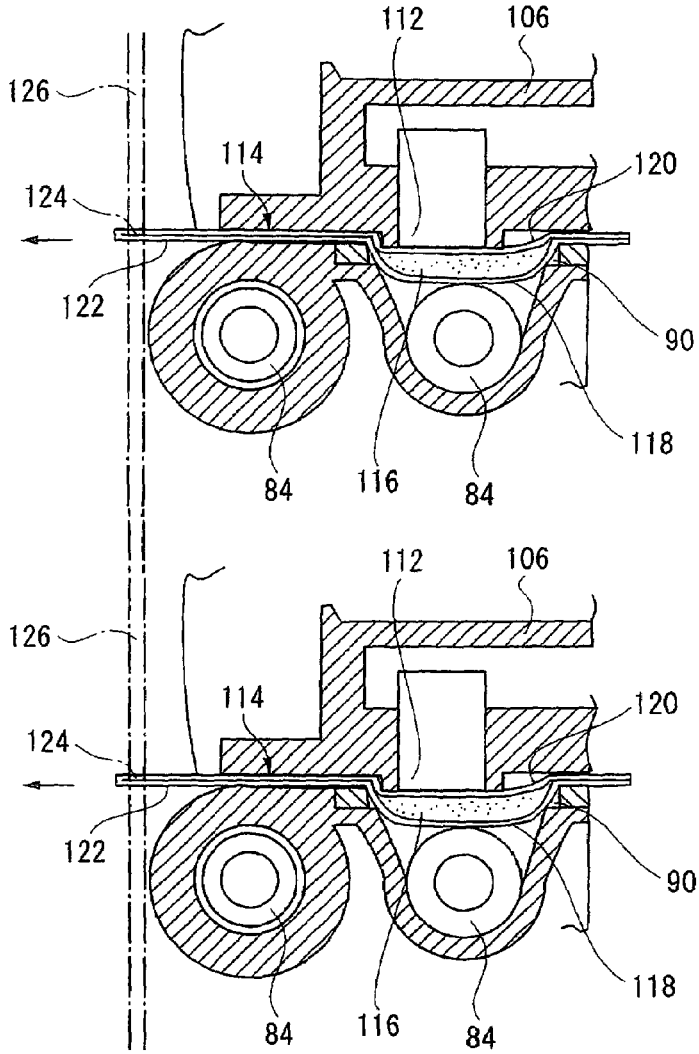
FIG. 10 is an enlarged cross-sectional view illustrating the developing devices, the seal portions, and the developer supply portions, which are used in the image forming apparatus according to the embodiment of the invention.

The drawing-out portion 122 is made of PET film, which is a flexible material, and is formed integrally with the lower sliding portion 118 and the upper sliding portion 120. An insertion hole 124 is formed in such a way as to penetrate through the drawing-out portion 122 in an up-down direction. As shown in FIG. 10, a jig 126 is inserted into this insertion hole 124.

As shown in FIG. 10, the seal portion 114 is disposed between the developer inlet port 90 of the developing device 60 and the developer supply port 112 of the developer supply portion 98. That is, the seal portion body 116 is compressed and fitted into the developer inlet port 90. The lower sliding portion 118 is brought into contact with the auger 84. The upper sliding portion 120 is put into contact with the developer supply port 112. The drawing-out portion 122 protrudes frontwardly from a joint portion between the developer inlet port 90 and the developer supply port 112. In a case where the seal portion 114 is mounted, the seal portion body 116 and the lower sliding portion 118 are fitted into the developer inlet port 90 of the developing device 60 so that the seal portion body 116 of the seal portion 114 is compressed. At that time, the free ends of the upper and lower sliding portions 120 and 118 are lined up. Thus, it can be checked whether the seal portion 114 is properly mounted in the developer inlet port 112. Subsequently, the pins 104 and 104 of the developer supply portion 98 are inserted into the elongated holes 102 and 102 of the developing device 60 are supported in such a way as to be able to slide with respect to the developer supply portion 98. Consequently, the seal portion body 116 is further compressed between the developing device 60 and the developer supply portion 98, so that the seal portion 114 can be mounted, as shown in FIG. 10, and that this seal portion 114 can seal between the developer inlet port 90 and the developer supply port 112.

Thus, even in a case where the image forming apparatus 10 undergoes vibrations due to the transportation thereof in a state in which this seal portion 114 is mounted, the seal portion 114 is disposed between the developer inlet port 90 of the developing device 60 and the developer supply port 112 of the developer supply portion 98. The seal portion body 116 is compressed and is brought into close contact with the developer inlet port 90 and the developer supply port 112. Consequently, the developer can be prevented from leaking from the joint portion between the developer inlet port 90 and the developer supply port 112.

Thus, even in a state in which the seal portion 114 is mounted, the auger 84 is in contact with the lower sliding portion 118 of the seal portion 114. This can assure the rotation of the auger 84. Therefore, in a state in which the seal portion 114 is mounted, a test image can be outputted by using a small amount of developer put into the developing device 60. Because the upper sliding portion 120 is disposed between the developing device 60 and the developer supply portion 98, the sliding motion of the developing device 60 can be assured, as shown in FIG. 7. Also, the retracting motion of the developing device 60 can be tested.

Next, a method of drawing out the seal portion 114 is described hereinbelow.

As shown in FIG. 10, in a state in which the seal portion 14 is mounted, the drawing-out portion 122 protrudes frontwardly from the developing device 60 and the developer supply portion 98. In this embodiment, the drawing-out portion 122 of each of the four seal portions 114, which respectively correspond to the four developing devices 60, protrudes frontwardly from the corresponding developing device 60. Thus, as indicated by double-dashed chain lines shown in FIG. 2, the jig 126 is inserted into the insertion hole 124 formed in the drawing-out portion 122. Then, this jig 126 is frontwardly drawn. Thus, the seal portion body 116 of the seal portion 114 is compressed still more. Also, the upper and the lower sliding portions 120 and 118 enable the seal portion 114 to slide between the developing device 60 and the developer supply portion 98. Consequently, the four seal portions 114 can collectively be drawn out from between the developing devices 60 and the developer supply portions 98 (two of the four seal portions 114 are shown in FIG. 10).

As described above, the invention can be utilized in an image forming apparatus that undergoes vibrations during the transportation thereof.

What is claimed is:

1. An image forming apparatus comprising:

an image forming apparatus main unit;

an image carrier provided in the image forming apparatus main unit;

at least one developing device supported retractably from the image carrier; and a developer supply portion adapted to supply developer to the developing device, wherein:

a developer inlet port provided in the developing device is slidably joined with a developer supply port provided in the developer supply portion;

a seal provided between the developer inlet port and the developer supply port;

the seal comprises a body made of an elastic material, a sliding member provided on at least one of the surfaces of the body, and a drawing-out portion connected to the seal body and to the sliding member; and the seal is enabled to be drawn out by using the drawing-out portion.

2. The image forming apparatus according to claim 1, wherein:

the sliding member of the seal is disposed to face a sliding part of each of the developer inlet port and the developer supply port.

3. The image forming apparatus according to claim 1, wherein:

the developing device has an auger adapted to convey developer inputted from the developer inlet port; and the sliding member of the seal is disposed to face the auger.

4. The image forming apparatus according to claim 1, further comprising a plurality of the developing devices, wherein there are a plurality of the seals disposed in the plurality of the developing devices, respectively, and the seals may be collectively drawn out by using one jig.

5. The image forming apparatus according to claim 1, wherein the sliding portion and the drawing-out portion are formed of flexible film integrally with each other.

6. A seal for use in an image forming apparatus, which is adapted to seal a developer inlet port provided in a developing device, and also seal a developer supply port provided in a developer supply portion, comprising:

a seal body made of an elastic material;

a sliding member, which is provided on at least one of the side surfaces of the seal body; and a drawing-out portion connected to the seal body, and to the sliding member, wherein the seal can be drawn out by using the drawing-out portion.

7. The seal for use in an image forming apparatus, according to claim 6, wherein the sliding member and the drawing-out portion are formed of a flexible material integrally with each other.

8. The image forming apparatus according to claim 1, wherein the body and the sliding member are made of different materials.

9. The seal according to claim 6, wherein the body and the sliding member are made of different materials.

10. The image forming apparatus according to claim 1, wherein the drawing-out portion comprises a receiving portion for receiving a jig.

11. The seal according to claim 6, wherein the drawing-out portion comprises a receiving portion for receiving jig.

12. The image forming apparatus according to claim 10, wherein the receiving portion comprises a hole.

13. The seal according to claim 11, wherein the receiving portion comprises a hole.

14. The image forming apparatus according to claim 1, wherein the body is disposed between the developer inlet port and the developer supply port; and a portion of the seal including the body is thicker than a portion of the seal including the drawing-out portion.

15. The seal according to claim 6, wherein the body is disposed between the developer inlet port and the developer supply port; and a portion of the seal including the body is thicker than a portion of the seal including the drawing-out portion.

16. The image forming apparatus according to claim 3, wherein the auger of the developing device makes contact with the sliding member.

* * * * *